United States Patent [19]

Kraizinger et al.

[11] 3,977,659

[45] Aug. 31, 1976

[54] CONVERTER

[76] Inventors: Fedor Vladimirovich Kraizinger, prospekt Metallurgov, 219, kv. 70; Alexei Ilich Zinsky, 27 kvartal, 13, kv.; Boris Fedorovich Getman, ulitsa Kavkazskaya, 6; Alexandr Semenovich Bruk, prospekt Lenina, 13, kv. 34; Sergei Sergeevich Eremenko, ulitsa Chernomorskaya, 20, kv. 47, all of Zhdanov Donetskoi oblasti; Alexei Ivanovich Maiorov, Novo-Alexeevskaya ulitsa, 3a, kv. 27; Vladimir Ivanovich Reshetov, Sayanskaya ulitsa, 11, kv. 374, both of Moscow, all of U.S.S.R.

[22] Filed: Apr. 24, 1975

[21] Appl. No.: 571,391

[52] U.S. Cl. ..... 266/245

[51] Int. Cl.[2] ..... C21C 5/50

[58] Field of Search ..... 266/35, 36 P, 36 H, 266/245

[56] References Cited

UNITED STATES PATENTS

| | | | |
|---|---|---|---|
| 2,976,090 | 3/1961 | McFeaters | 266/36 P |
| 3,348,834 | 10/1967 | Stafford et al. | 266/36 P |
| 3,536,310 | 10/1970 | Kalb et al. | 266/36 P |

*Primary Examiner*—Roy Lake
*Assistant Examiner*—Paul A. Bell
*Attorney, Agent, or Firm*—Haseltine, Lake & Waters

[57] ABSTRACT

There is proposed a converter, comprising a body set up in a trunnion ring with trunnions on which multimotor drives are mounted with the gear hub of a low-speed reducer, with at least one trunnion being provided on the side of the multimotor drive with a bush and with said gear hub having a socket adapted to be joined with said bush, whose external surface is adjusted to fit in shape and size the corresponding surface of the socket, through which the trunnion is coupled with the gear hub of the low-speed reducer by means of a flexible joint.

11 Claims, 12 Drawing Figures

CONVERTER

Figure 1:
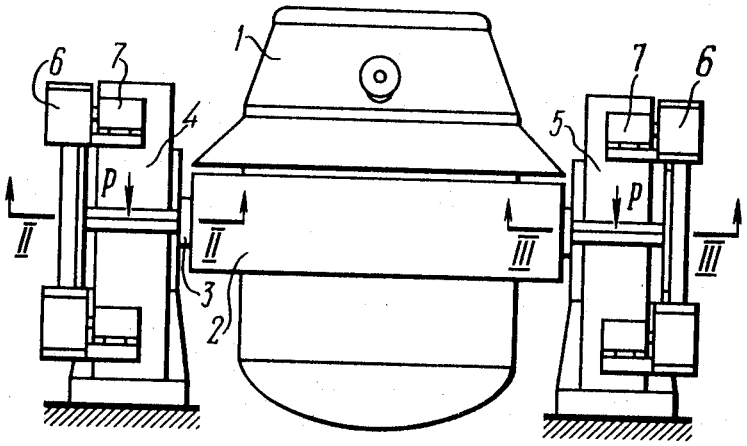

The present invention relates to plants for producing steel and non-ferrous metals and more particularly to converters which fined use in nonferrous and ferrous metallurgy.

Known in the art is a converter for producing steel, comprising a body mounted in a trunnion ring, bearing units, a stationary drive in which the output shaft of a low-speed reducer is coupled to a converter ring trunnion through a toothed clutch or a spindle.

A disadvantage of the known converter design lies in large length of its shaft line (converter ring trunnion - toothed clutch -output shaft of the low-speed reducer) transmitting the torque to the trunnion ring which results in an increase in converter overall dimensions. In operation the converter body swings owing to elastic twisting of the above shafting and backlashes in the toothed clutch or spindle. The swinging of the converter body increases dynamic loads acting on the body, trunnion ring and drive gearing. The above outlined disadvantages inherent in this converter lead to early wear of its units and elements which adversely affects its reliability and longevity. Large overall dimensions of this converter require larger floor areas and hence heavier outlays during construction.

A converter with a multimotor drive set on with the gear hub of a low-speed reducer on the converter ring trunnion secured in bearing units is more advanced in design. At the opposite sides of the low-speed reducer housing there are locking devices connected thereto by means of resilient members taking up the torque.

The overall dimensions of such a converter and the swinging of its body are decreased.

However, it is not deprived of certain disadvantages. Considered hereinbelow are the loads applied to bearing units on the side of the multimotor drive. On the side of the converter body the bearing unit is exposed to a load which amounts to the half-weight of the converter body with lining, trunnion ring and molten metal, i.e. to a load P.

On the side of the multimotor drive set on the ring trunnion the bearing unit is subjected to a load constituted by the weight of the multimotor drive $P_1$ that is summed up with the above-mentioned load P and is equal to $P + P_1$.

Thus, a disadvantage of this design resides in that on the side of the multimotor drive the bearing unit is exposed to an additional load constituted by the weight of said drive. This causes untimely wear of the bearing unit, whereas the replacement of bearings presents difficulties since it involves the dismantling of a multimotor drive.

In another known converter the problem of decreasing the converter overall dimensions is solved by mounting a pair of bearing units along the diameter, on the opposite sides of the converter. One of these bearing units is the low-speed reducer of a stationary drive whose output shaft has a bush on its internal end, with the bush shape and size being adjusted to fit the corresponding elements of the space formed on the converter body by special brackets. The bush is provided with radial projections, whose size and shape allow butting them against the grooves in the converter body brackets.

The overall dimensions of this converter, like of the preceding one, are decreased owing to an increase in the load on the reducer bearing on the side of the converter body. Thus, if the half-weight of the converter body is denoted by P and the distance from the centre of attachment of the converter body on the shaft bush to the bearing on the body side by $l_1$ and that between two bearings of the low-speed reducer output shaft by $l_2$, then with $l_1=l_2$ the load acting on the bearing on the side of the converter body will amount to 2P, and with $2l_1=l_2$ the load applied to the bearing will be equal to 1.5P, accordingly.

The value $l_1$ is determined by the dimensions of the fastening elements: the bush and brackets. An increase in $l_2$ is not expedient, since $l_2$ has a considerable influence on the converter size when the load applied to the bearings is decreased to 1.2P –1.3P.

With $l_2$ being increased substantially the overall dimensions of the converter will approximate those of the converter with a stationary drive, which makes the expediency of this construction dubious.

Additional loads applied to trunnion bearings not related to the increase in converter capacity adversely affect its performance, increase the number of repairs and add to converter idle time, all this reducing industrial efficiency of the converter.

It is an object of the present invention to overcome the above disadvantages peculiar to the world converter practice.

Another object of the invention is the provision of a small-size converter with an enhanced working ability of its bearing units on the side of a multimotor drive owing to a reduction in loads acting thereon.

Said and other objects of the invention are achieved by providing a converter, comprising a body, a trunnion ring with trunnions, elements for securing the converter body in the trunnion ring and a multimotor drive set on with the gear hub of a low-speed reducer on the ring trunnion, wherein, according to the invention, at the trunnion end facing the multimotor drive there is a bush and the gear hub has a socket adapted to be joined with said bush, whose external surface is adjusted in shape and size to fit the corresponding surface of the socket through the ring trunnion is coupled with the gear hub of the low speed reducer by means of a flexible joint.

The socket of the low-speed reducer gear hub can be mounted either movably axially or locked in position.

It is sound practice that the gear hub accommodating a toothed bush with radial barrel-shaped teeth, and the low-speed reducer gear hub of the multimotor drive being fitted with corresponding straight teeth mating with the bush barrel-shaped teeth.

It is reasonable that the barrel-shaped teeth of the bush and straight hub teeth conjugate with the help of a toothed annular socket.

It is also expedient that the bush be provided with radial projections and the gear hub of the low-speed reducer with corresponding projections, with the bush and hub projections being separated by resilient elements, such as, springs.

According to the object of the present invention, it is reasonable that the ring trunnion be fitted with a tail made integral therewith, with the gear hub of the low-speed reducer accommodating a toothed bush aligned axially with the trunnion and having a slot conjugated by means of inserts with said tail, with the barrel-shaped teeth of the toothed bush being disposed intermediate of the straight teeth of the low-speed reducer gear hub.

It is good practice that on the slot side the toothed bush be fitted with a tire, and the gear hub of the low-speed reducer of the multimotor drive with ribs, preferably, circular.

It proved to be most advantageous that on the side of the trunnion ring the gear hub of the low-speed reducer of the multimotor drive be provided with projections and the trunnion ring with corresponding projections mating with those of the hub by means of inserts conjugated with one of the projections, preferably, along the cylindrical surface.

Finally, it is most expedient and technologically efficient that the trunnion ring be connected to the gear hub of the low-speed reducer of the multimotor drive through a torque transmitting gear made, e.g., as at least one torsion shaft mounted rotatably in bearings on the trunnion ring, with the shaft ends mounting cranks rigidly fixed and coupled through articulated rods with the projections on the gear hub of the multimotor drive low-speed reducer.

The herein-proposed converter design offers a considerable reduction in the converter overall dimensions along with an increase in its capacity which is of particular importance when modernizing steel-melting shops with a view to providing a maximum increase in their output.

Installation of the thus-embodied converters in converter shops would make it possible to decrease substantially floor area requirements, shop construction outlays and increase appropriately their output, as compared with similar now-existing converter shops all other conditions being equal.

Characteristic of the proposed converter are relatively low loads on its bearing units, a feature ensuring their perfect performance.

Unique mechanical joints and gears for transmitting torques to the converter trunnion ring feature high reliability, allow damping peak loads on the drive, being in the meantime simple in erection and operation.

Figure 2:
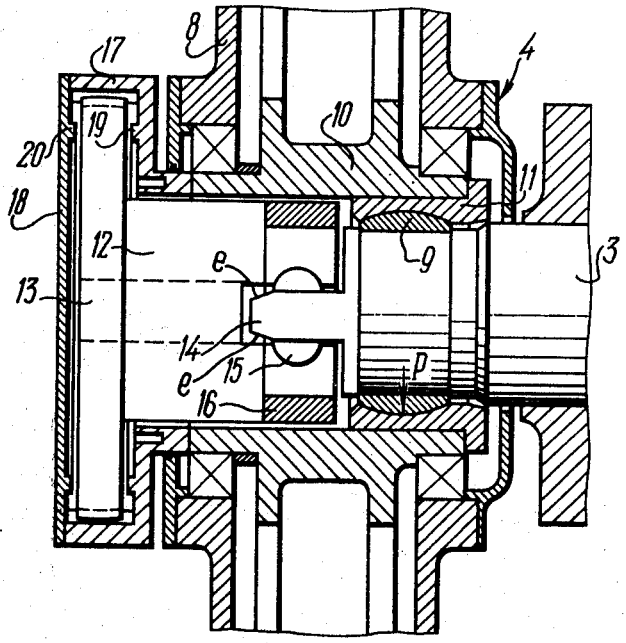
Figure 3:
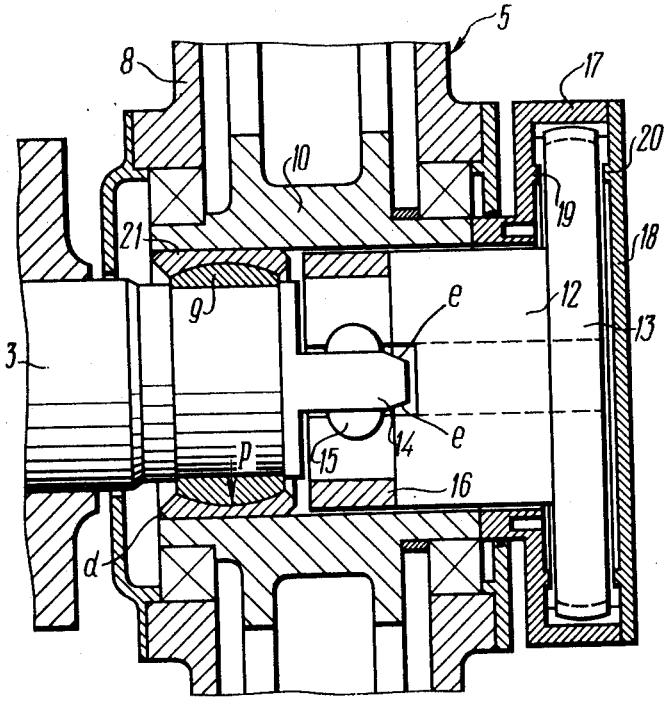
Figure 4:
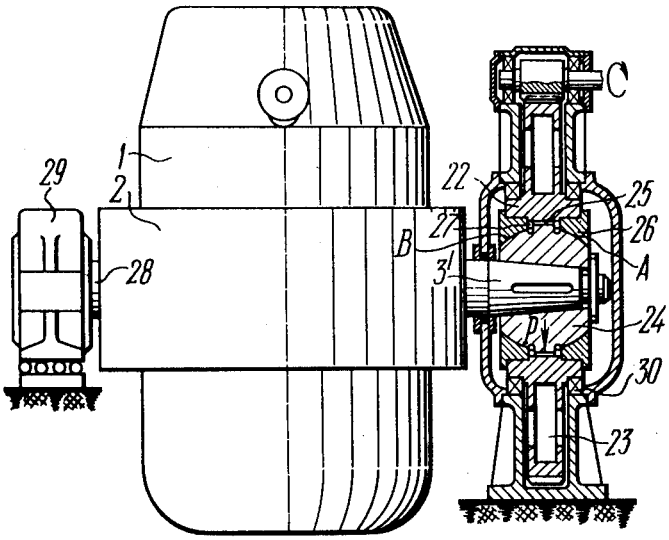
Figure 5:
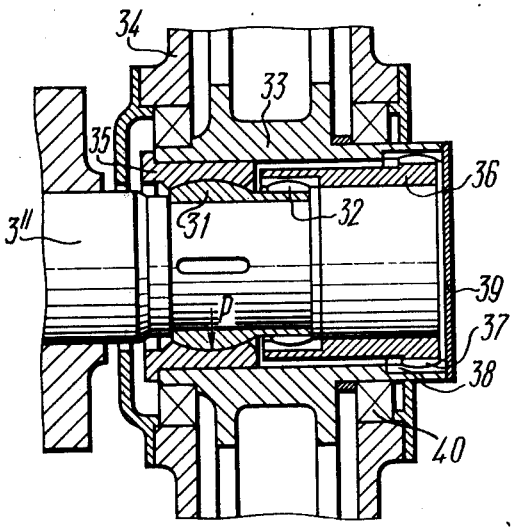
Figure 6:
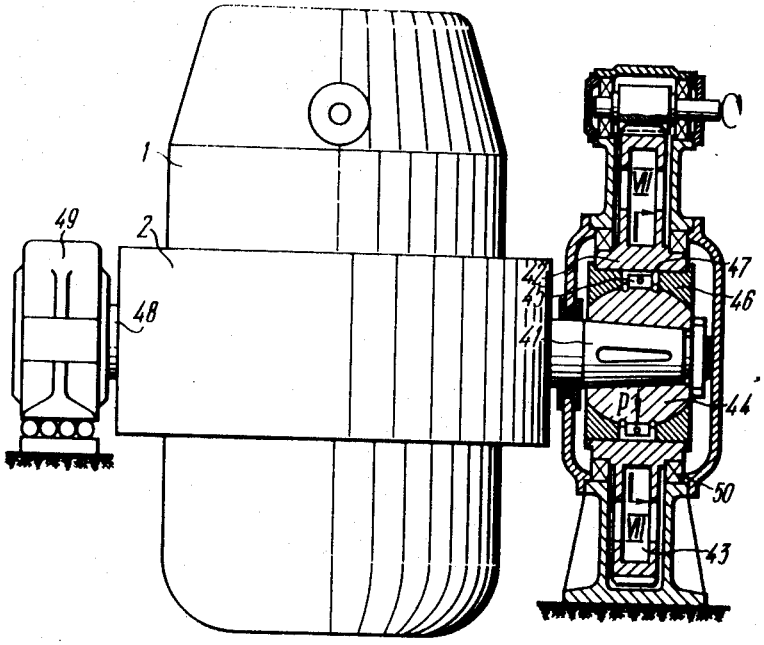
Figure 7:
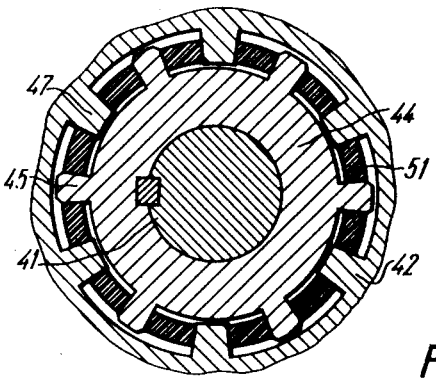
Figure 8:
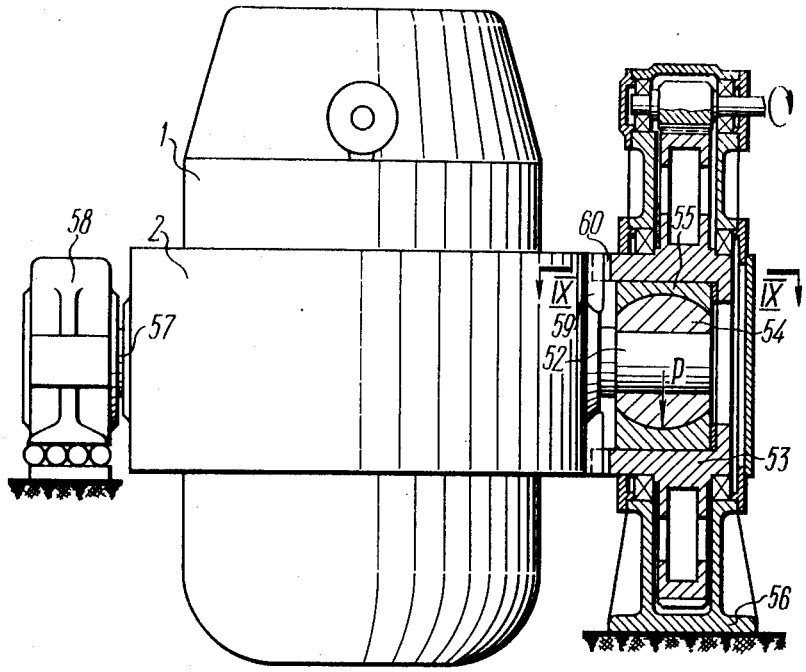
Figure 9:
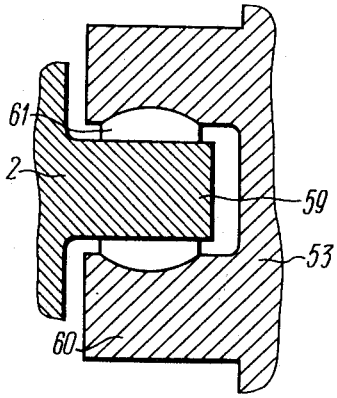
Figure 10:
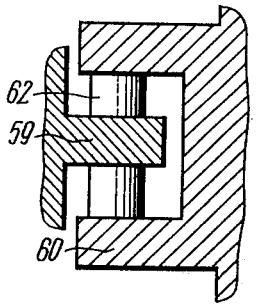
Figure 11:
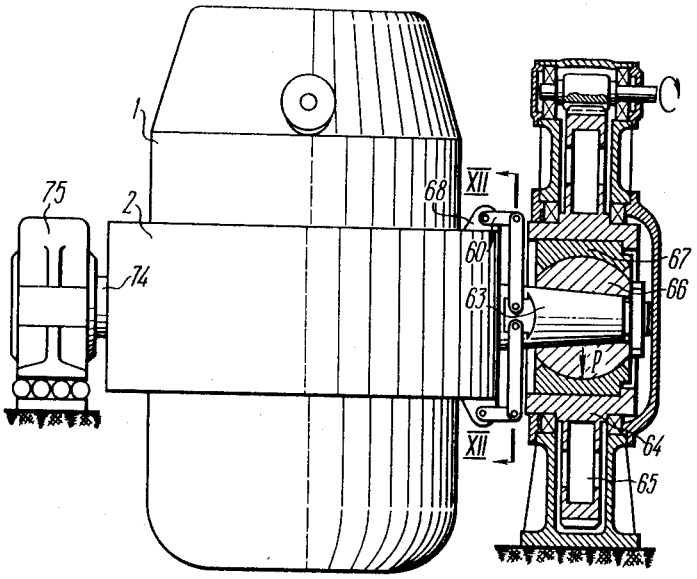
Figure 12:
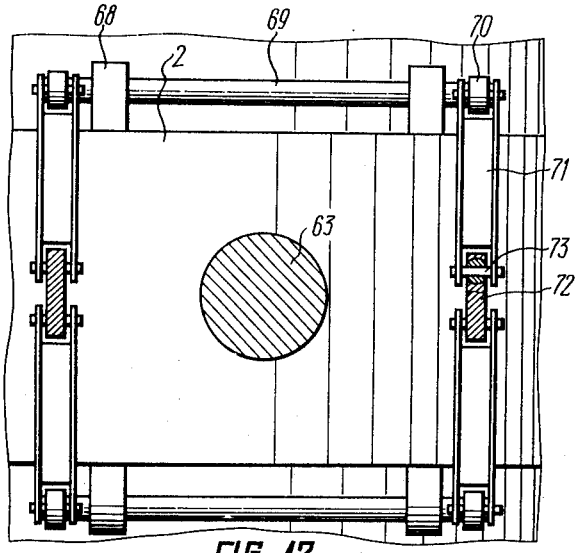

In the herein-proposed converter the elements adapted to offset the misalignment of the drive trunnion and the converter geometric spinning axis are practically locked in position with respect to each other when the converter is brought into rotation, being therefore not subjected to wear and not requiring additional investments for their repairs and servicing. The nature of the invention will be clear from the following detailed description of particular embodiments thereof, to be had in conjunction with the accompanying drawings, in which:

FIG. 1 shows the converter design with the multimotor drive arranged on both sides, according to the invention;

FIG. 2 — section II—II of FIG. 1, according to the invention;

FIG. 3 — section III—III of FIG. 1, according to the invention;

FIG. 4 gives a cross-sectional view of the possible embodiment of the converter with the multimotor drive arranged on one side, according to the invention;

FIG. 5 shows the drive trunnion attachment in the gear hub of the low-speed reducer of the converter multimotor drive, according to the invention;

FIG. 6 gives a cross-sectional view of another embodiment of the converter with the multimotor drive arranged on one side, according to the invention;

FIG. 7 — section VII—VII of FIG. 6;

FIG. 8 is a cross-sectional view of one more possible embodiment of the converter with the multimotor drive arranged on one side, according to the invention;

FIG. 9 — section IX—IX of FIG. 8, according to the invention;

FIG. 10 — shows the unit with damping inserts, according to the invention;

FIG. 11 shows one of the possible embodiments of the converter with the multimotor drive arranged on one side (a cross-sectional view);

FIG. 12 — section XII—XII of FIG. 11. A converter, according to the invention, comprises a body 1 (FIG. 1) set up in a trunnion ring 2 which rests with its drive trunnions 3 on the multimotor drives 4 and 5.

The multimotor drive 4 is a fixed converter support and the multimotor drive 5 — its floating bearing unit.

The multimotor drives 4 and 5 are identical in design, each comprising a high-speed reducer 6 with motors 7 and low-speed reducers 8 (FIGS. 2 and 3) fixed rigidly to the base plate. The drive: trunnion 3 of the converter trunnion ring 2 mounts a bush 9 with a spherical external surface. On a side of the bush 9 a gear hub 10 (FIG. 2) of the low-speed reducer 8 of the multimotor drive 4 is provided with a socket 11 fixed axially, with the internal surface of the socket 11 mating at the point of its contact with the bush 9 being made also spherical. The socket 11 is split in a plane passing through its axis and is secured with its collar on the end face of the gear hub 10 of the low-speed reducer 8.

The external surface of the bush 9 is adjusted to fit the corresponding surface of the socket 11 so that with their maximum surface contact the bush 9 has a possibility of turning relative to the socket 11 through an angle exceeding the maximum admissible skewing angle of the drive trunnion 3.

The space of each hub 10 (FIGS. 2 and 3) of the multimotor drives 4 and 5 accommodates a toothed bush 12 whose one end face is fitted with a rim 13 with barrel-shaped teeth, and another end face with a spindle-type slot conjugated with the tail 14 of the drive trunnion 3 with the help of cylindrical inserts 15. The toothed bush 12 carries a tire 16 mounted on the slot side. Fixed rigidly on the end face of the hub 10 on the opposite side of the bush 9 is a socket 17 with straight teeth. The socket 17 is made integral with the hub 10. The space of the socket 17 is closed with a cover 18. The socket 17 and cover 18 have ribs 19 and 20 accordingly, preferably, circular.

In contrast to the multimotor drive 4, in the multimotor drive 5 (FIG. 3), acting as the floating bearing unit, the hub 10 is fitted on the side of the bush 9 with a socket 21 mounted movably axially. On the side of the hub 10 the socket 21 is provided with guide annular chamfers *d*. At the point of contact with the bush 9 the internal surface of the socket 21 is also spherical.

The external surface of the bush 9, like in the multimotor drive 4 (FIG. 2), is adjusted to fit the corresponding surface of the socket 21 (FIG. 3) so that with their maximum contact the bush 9 is capable of being turned with respect to the socket 21 through an angle exceeding the maximum admissible skewing angle of the drive trunnion 3.

Considered hereinafter is the operation of the proposed converter.

In the course of operation the converter body 1 (FIG. 1) is tilted and rotated by the multimotor drives 4 and 5 in which the torque is transmitted from the motors 7 through the high-speed reducers 6 and low-speed reducers 8 (FIGS. 2 and 3) to the gear hubs 10 of the low-speed reducers 8. From the hubs 10 the torque is transmitted through the sockets 17 rigidly fixed thereon, with the straight teeth of the sockets 17 coming into engagement with the barrel-shaped teeth of the rims 13, to the toothed bushes 12 with their slots rotating through the inserts 15 the tails 14 of the drive trunnions 3 of the converter trunnion ring 2. Each toothed bush 12 enables the torque to be transmitted from the hub 10 to the trunnion 3 of the trunnion ring 2 with a certain skewing of the axis of the trunnion 3 with respect to that of the hub 10.

It should be emphasized that with the hubs 10 of the multimotor drives 4 and 5 being aligned axially, the bushes 9 and toothed bushes 12 are at first self-aligned in the spaces of the hubs 10, whereupon each bush 9 and toothed bush 12 remains locked in position with respect to the hub 10.

With the misaligned spaces of the hubs 10 the bushes 9 can rotate through a certain angle $\alpha$ in the socket 11 (FIG. 2) or socket 21 (FIG. 3), with the angle not exceeding the maximum admissible skewing angle of the bush 9 relative to said sockets 11 and 21.

Constant selfalignment of the drive trunnions 3 (FIGS. 2 and 3) with rigidly fixed bushes 9 in the socket 11 (FIG. 2) or socket 21 (FIG. 3) causes radial displacement of the tail 14 (FIGS. 2 and 3) of the drive trunnions 3. Its displacement in a vertical plane is offset by the displacement of the barrel-shaped teeth of the rims 13 relative to the straight teeth of the sockets 17 and of the tails 14 in the slots of the toothed bush 12, the latter being made up for by the rotation of the cylindrical inserts 15.

Horizontal displacement is compensated for by the shifting of the barrel-shaped teeth of the rims 13 with respect to the straight teeth of the socket 17 and of the tails 14 along the sliding surfaces of the cylindrical inserts 15. Spontaneous axial displacement of each toothed bush 12 is restricted by the ribs 19 and 20 on the socket 17 and cover 18.

In spite of backlash provided in each circuit: hub 10 -drive trunnion 3, the body 1 (FIG. 10 does not oscillate owing to a large contact surface between the bush 9 (FIGS. 2 and 3) and socket 11 (FIG. 2) or bush 9 and socket 21 (FIG. 3) and to frictional forces arising on the above-mentioned contact surface.

The frictional forces brought about on the contact surfaces of the bush 9, socket 11 (FIG. 2) and socket 21 (FIG. 3) diminish materially acceleration of the toothed bush 12 (FIGS. 2 and 3) during drive reversal. Owing to this the side play between the tooth profiles of the straight teeth of the socket 17 and mating barrel-shaped teeth of the rim 13 is gradually and gently (shocklessly) reduced to zero, which diminishes dynamic loads on the converter.

Thermal expansion of the trunnion ring 2 (FIG. 1) is offset by the multimotor drive 5 acting as the floating bearing unit. This is attributable to axial displacement of the socket 21 (FIG. 3) along the internal surface of the gear hub 10 of the low-speed reducer 8 and to the displacement of the tail 14 of the drive trunnion 3 relative to the inserts 15 of the toothed bush 12 which in turn is movable axially being restricted by the ribs 19 and 20.

For more convenient erection the tail 14 has chamfers *e* and for transmitting a maximum posible torque it is reinforced. The end of the toothed bush 12 is reinforced in the slot zone for example by a special tire 16 that may be made integral therewith or wound of high-strength strip.

If the load acting on one bearing unit and constituted by the weight of the converter body is denoted by $P_1$, the load on the bearings of the gear hub 10 of the low-speed reducer will be distributed as follows.

With the vertical axis of the bush 9 equidistant from the bearings of the hub 10 the load on one bearing amounts to 0.5P. With the vertical axis of the bush 9 displaced toward one of the bearings of the hub 10, the load on this bearing will grow but not in excess of P.

Thus, by placing the socket 11 (FIG. 2) or socket 21 (FIG. 3), on which the drive trunnion 3 rests through the rigidly fixed bush 9 (FIGS. 2 and 3), in the space of the gear hub 10 of the low-speed reducer 8 of the multimotor drive, it is possible to offset the skewing of the drive trunnion with respect to its geometric axis of rotation in the gear hub 10 of the multimotor drive low-speed reducer 8.

As the hub 10 rotates synchronously with the drive trunnion 3, it provides for the creation of necessary conditions for offsetting the skewing of the drive trunnion 3 with minimum losses due to friction of mating surfaces of the bush 9 and its corresponding socket, i.e. the bush 9 either does not change its position with respect to the hub 10 or these changes are so negligible that they do not cause any additional loads (due to friction) on the hub 10.

FIG. 4 shows the converter with the multimotor drive arranged on one side. In this converter the drive trunnion 3' of the trunnion ring 2 rests on the gear hub 22 of a low-speed reducer 23 through a spherical bush 24, mounted on a drive trunnion 3' and fitted with a toothed rim 25, and two spherical sockets 26 secured in the space of the gear hub 22 of the low-speed reducer 23.

The axis of symmetry of the toothed rim 25 passes through the geometric centre of hemispheres A and B, its barrel-shaped teeth coming into engagement with the straight teeth 27 of the gear hub 22 of the low-speed reducer 23. The idle trunnion 28 of the trunnion ring 2 rests on a floating bearing unit 29 (of any known design) which makes it possible to make up for thermal expansion of the trunnion ring 2 toward the converter spinning axis.

Considered hereinbelow is the operation of this converter.

When rotating the hub 22 transmits the drive torque through the straight teeth 27 to the mating barrel-shaped teeth of the toothed rim 25 and accordingly to the spherical bush 24 fixed rigidly on the drive trunnion 3' which in turn transmits the torque to the trunnion ring 2. Frictional forces arising on the spherical surfaces contribute to a smooth reduction to zero of gear backlash and preclude the swinging of the converter body 1 during blowing and other production processes.

The spherical bush 24 allows transmitting the torque from the hub 22 to the trunnion 3' of the trunnion ring 2 with a certain skewing of the axis of the trunnion 3' relative to that of the hub 22.

With the spaces of the low-speed reducer 23 and floating bearing unit 29 being aligned axially, the spherical bush 24 is first self-aligned in the spherical socket 26, the barrel-shaped teeth of the toothed rim 25 are also aligned with respect to the straight teeth 27 of the gear hub 22, whereupon the spherical bush 24 remains locked in position with respect to the gear hub 22.

With the misaligned spaces of the low-speed reducer 23 and floating bearing unit 29, the spherical bush 24 is capable of rotating in the spherical sockets 26 through an angle $\alpha$(tg $\alpha = a/b$, where: $a$ — the amount of misalignment; $b$ — the spacing between the vertical axes of the spherical bush 24 and floating bearing unit 29).

Since the value $a$ is adjustable in the course of erection or repairs and is incomparably less than the value $b$, the skewing angle of the spherical bush 24 $\alpha \approx 0°$, i.e. actually the spherical bush 24 is fixed with respect to the gear hub 22 and spherical sockets 26.

Like in the above outlined case, the maximum load on the bearings 20 of the hub 22 will depend on the relative position of the spherical bush 24 and bearings 30, ranging within 0.5P–P.

Considered hereinafter is the embodiment of the multimotor converter drive, with the drive trunnion 3'' (FIG. 5) of the converter trunnion ring being fitted with a bush 31 fixed rigidly on the drive trunnion 3''. One end of the bush 31 is spherical, the other end terminates with a toothed rim 32 with barrel-shaped teeth. On the side of the bush 31 a gear hub 33 of a low-speed reducer 34 is provided with a socket 35 fixed rigidly axially, with the socket internal surface being made spherical and corresponding to the fraction of the spherical surface of the bush 31.

The socket 35 is split in a plane passing through its axis, its collar being fastened to the end face of the gear hub 33 of the low-speed reducer 34.

The space of the hub 33 accommodates a socket 36 provided on one side with straight teeth mating with the barrel-shaped teeth of the toothed rim 32 of the bush 31, its another side having a toothed rim 37 whose barrel-shaped teeth with a straight teeth 38 of the hub 33. The space of the hub 33 is closed with a cover 39.

With the multimotor drive in operation the torque from the hub 33 is transmitted through its straight teeth 38 to the toothed rim 37 of the socket 36 whose straight teeth are brought into engagement with and transmit the torque to the barrel-shaped teeth of the toothed rim 32 of the bush 31. The latter (i.e., the bush 31) is rigidly connected to the drive trunnion 3'' which transmits the torque to the converter trunnion ring.

The bush 31 of the socket 35 allows a certain amount of skewing of the axis of the trunnion 3'' relative to that of the hub 33. The socket 36 affords transmitting the torque with the trunnion 3'' being skewed in the above manner.

With the spaces of the hub 33 and of the opposite bearing unit, on which the idle trunnion of the trunnion ring rests, being aligned axially the bush 31 is first self-aligned owing to its spherical portion accommodated in the socket 35 of the gear hub 33 of the low-speed reducer. The socket 36 also enclosed within the space of the hub 33 is self-aligned as well, whereupon both the bush 31 and socket 36 remain locked in position with respect to the hub 33.

With the spaces of the hub 33 and opposite bearing unit being misaligned, the bush 31 is capable of rotating in the socket 35 with the concurrent displacement of the toothed rim 32.

This displacement is offset by the inclination of the socket 36 and displacement of the barrel-shaped teeth of the toothed rims 32 and 37 relative to the mating straight teeth of the socket 36 and hub 33. Backlash in the gears of the circuit: hub 33 - bush 31 does not cause the swinging of the converter body and shocks during the drive reversal, since they are precluded by frictional forces brought about on the contact surfaces of the spherical part of the bush 31 and socket 35.

The load on bearings 40 of the hub 33, as it has been shown earlier, will be dependent on the relative position of the bush 31 and bearings 40, ranging within 0.5P–P.

FIG. 6 shows another possible converter embodiment with the multimotor drive arranged on one side. With the above arrangement the drive trunnion 41 of the trunnion ring 2 rests on the gear hub 42 of a low-speed reducer 43 through a spherical bush 44. The latter is set on the drive trunnion 41 and is fitted with radial projections 45. The spherical bush 44 is arranged intermediate of two spherical sockets 46 secured in the space of the gear hub of the low-speed reducer 43.

The axis of symmetry of the radial projections 45 passes through the geometric centre of the external surface of the spherical bush 44. The gear hub 42 is provided with projections 47 which are also radial. An idle trunnion 48 of the trunnion ring 2 rests on a floating bearing unit 49 which allows offsetting thermal expansion of the trunnion ring 2 towards the converter spinning axis. The gear hub 42 of the low-speed reducer 43 is provided with bearings 50 through which it rests on the housing of the low-speed reducer 43. The projections 45 and 47 do not come in direct contact with each other but conjugate through resilient elements 51 (FIG. 7) set up in the clearances between said projections 45 and 47. The resilient elements 51 are manufactured from elastic materials, such as: rubber, plastics, or spring, hydraulic, pneumatic or combination-type shock absorbers may be used.

To provide for the transmission of a maximum torque without longitudinal distortion the resilient elements 51 are prestressed.

With the multimotor drive in operation the torque from the gear hub 42 (FIG. 6) is transmitted through the projections 47 to the resilient elements 51, which rotate, through the projections 45, the spherical bush 44 rigidly fixed on the drive trunnion 41 of the converter trunnion ring 2.

The spherical bush 44 transmits the torque from the hub 42 to the trunnion 41 of the trunnion ring 2 with a certain skewing of the axis of the trunnion 41 with respect to that of the gear hub 42.

With the spaces of the low-speed reducer 43 and floating bearing unit 49 being aligned axially, the spherical bush 44 is at first self-aligned in spherical sockets 46, the projections 45 (FIGS. 6 and 7) being self-aligned relative to the projections 47 and resilient elements 51 (FIG. 7) relative to the projections 45 and 47, whereupon the spherical bush 44 remains fixed relative to the gear hub 42 with the multimotor drive 43 transmitting the rated torque. The resilient elements 51 are also locked in position with respect to the projections 45 and 47.

At peak loads acting on the multimotor drive 43 (FIG. 6) tne spherical bush 44 revolves in the sockets 46, the projections 45 contract the resilient elements 51 (FIG. 7) transmitting a gradually increasing load to the projections 47 of the gear hub 42. The load on the multimotor drive 43 grows progressively, i.e. the dynamic loads are damped.

With the peak loads reduced to their rated value the resilient elements 51 urge the teeth 45 of the spherical bush 44 to return into their original position, and the converter keeps working under normal conditions.

With the misaligned spaces of the low-speed reducer 43 (FIG. 6) and floating bearing unit 49 the spherical bush is capable of rotating in the spherical sockets 46 through an angle $\alpha$. In this case the projections 45 are displaced with respect to the projections 47, the displacement being offset by transverse strain of the resilient elements 51 (FIG. 7) owing to which mechanical linkage between the projections 45 and 47 is not disturbed.

It is worth noting that the angle $\alpha \approx 0°$ and actually the spherical bush 44 with the projections 45 is not displaced relative to the gear hub 42 with the projections 47, which has a favourable influence on converter operation as a whole.

FIG. 8 shows the converter with a multimotor drive arranged on one side but with a drive trunnion 52 of the trunnion ring 2 resting on a hub 53 through a spherical bush 54 and socket 55 mounted and secured in the space of the gear hub 53 of a low-speed reducer 56.

For the sake of convenience during erection the socket 55 is split in a plane passing through its axis.

An idle trunnion 57 of the trunnion ring 2 is set up in a floating bearing unit 58 of the known construction which makes it possible to make up for thermal expansion of the trunnion ring 2.

To transmit the torque directly from the gear hub 53 to the trunnion ring 2 the latter is provided with projections 59 arranged in the vertical plane of the trunnion ring 2 on the side of the drive trunnion 52.

The gear hub 53 of the low-speed reducer 56 is fitted with projections 60 with slots corresponding to the projections 59.

Mounted intermediate of the projections 59 of the trunnion ring 2 and bearing surfaces of the slots between the projections 60 of the hub 53 are cylindrical inserts 61 (FIG. 9).

FIG. 10 depicts same projections 59 and 60 but with their bearing surfaces separated not by the cylindrical inserts 61 but by damping bushes 62. The latter differ from the cylindrical inserts in that they feature a broader elastic strain range, being shaped e.g., as precompressed springs.

The drive torque from the gear hub 53 (FIG. 8) of the low-speed reducer to the trunnion ring 2 is transmitted through the bearing surfaces of the projections 60 and cylindrical inserts 61 (FIG. 10) to the projections 59 of the trunnion ring 2. The original skewing of the trunnion 52 (FIG. 8) of the trunnion ring 2 relative to the axis of the gear hub 53 is offset owing to the self-alignment of the spherical bush 54 in the socket 55 of the gear hub 53 and by adjusting the inserts 61 (FIG. 9) to fit actual clearances between the bearing surfaces of the projections 59 and 60.

With the spaces of the low-speed reducer 56 (FIG. 8) and floating bearing unit 58 being aligned axially, the spherical bush 54 and projections 59 remain fixed relative to the hub 53 and its projections 60 with the slots mating the projections 59.

With the misaligned spaces of the low-speed reducer 56 and floating bearing unit 58 the spherical bush 54 is capable of rotating in the socket 56 and the projections 59 and 60 can displace relative to each other along the sliding planes of the cylindrical inserts 61 (FIGS. 8 and 9) and owing to guaranteed clearances in their connection.

Since the projections 59 and 60 are arranged vertically, the deformation of the trunnion ring 2 can be offset in the direction of minimum rigidity. Eventually the deflection of the trunnion ring 2 does not impair the performance of the drive and is offset owing to the displacement of the projections 59 with respect to the projections 60 along the sliding planes of the cylindrical inserts 61.

Installation of damping inserts 62 (FIG. 10) between the projections 59 of the trunnion ring 2 and the bearing surfaces of the slots, separating the projections 60 of the gear hub 53 of the low-speed reducer 56, enables the dynamic loads to be taken up by the multimotor converter drive.

At a sharp rise in loads on the multimotor drive, the spherical bush 54 (FIG. 8) rotates in the socket 55. At the same time the projections 59 shift with respect to the projections 60 contracting the damping inserts 62 (FIG. 10).

The load on the drive augments gradually which enhances its working ability.

If the load decreases to its rated value, the damping inserts 62 return the projections 59 and spherical bush 54 (FIG. 8) into their initial position.

Like in the above outlined cases, the maximum load on the bearings of the low-speed reducer 56 will be dependent on the relative position of the spherical bush 54 and the above-mentioned bearings, ranging from 0.5P to P.

FIG. 11 shows the converter with the multimotor drive arranged on one side with a drive trunnion 63 of the trunnion ring 2 resting on a gear hub 64 of a low-speed reducer 65 by means of a spherical bush 66 and socket 67 mounted and secured in the space of the gear hub 64 of the low-speed reducer 65. The socket 67 is split in a plane passing through its axis, its collar being fastened to the end faces of the gear hub 64 of the low-speed reducer with its internal surface in contact with the spherical bush 66 being also made spherical.

With a view to providing direct transmission of the torque from the hub 64 to the trunnion ring 2, the latter, on the side of the multimotor drive, is fitted with four bearings 68 equidistant from a vertical plane passing through the axis of the trunnion 63. The spaces of the upper and lower pairs of these bearings 68 accommodate each one torsion shaft 69 (FIG. 12). The protruding tails of the torsion shafts 69 carry rigidly fixed cranks 70 coupled by articulated rods 71 with mating projections 72 of the gear hub 64 of the low-speed reducer 65. The fastening units of the articulated rods 71 and cranks 70 and projections 72 include ball joints 73. An idle trunnion 74 (FIG. 11) rests on a floating bearing unit 75 of the known design which makes it possible to offset thermal expansion of the trunnion ring 2 toward the converter spinning axis.

In the course of operation of the multimotor drive the torque acting on the hub 64 (FIG. 11) is transmitted through the projections 72 (FIG. 12) to the rods 71 which, when transmitting the load to the cranks 70, twist the torsion shafts 69 through a certain angle with the reactions arising in the bearings 68 producing a torque on the trunnion ring 2.

The diameters of the torsion shafts 69 are selected so that when transmitting the rated torque the angle of twist of the torsion shaft 69 is small. At an abrupt rise in dynamic loads on the drive the torsion shafts 69 are twisted through a larger angle and damp the dynamic loads on the drive.

The torsion shafts 69 with the cranks 70 and rods 71 allow transmitting the torque from the hub 64 (FIG. 11) to the drive trunnion 63 of the trunnion ring 2 with a certain skewing of the axis of the drive trunnion 63 with respect to that of the hub 64.

The skewing of the drive trunnion 63 in any plane is offset by the rotation of the spherical bush 66 in the socket 67 through a certain angle and by the inclination of the rods 71 (FIG. 12) which rotate the cranks 70 with the torsion shafts 69 in the bearings 68.

With the spaces of the low-speed reducer 65 (FIG. 11) and floating bearing unit 75 being aligned axially, the spherical bush 66 is at first self-aligned in the socket 67. The kinematic chain: rod 71 (FIG. 12) = crank 70 - torsion shaft 69, which may be referred to hereinafter for convenience as a torque transmitting gear, is also self-aligned.

With the misaligned spaces of the low-speed reducer 65 (FIG. 11) and floating bearing unit 75 in the course of rotation of the converter body 1 the position of the spherical bush 66 in the socket 67 changes with the elements of the torque transmitting gear being also rearranged with respect to one another.

However, it was shown that these changes were negligible and actually all the above-specified elements remain locked in position with respect to each other.

It should be emphasized that the torque transmitting gear can be produced by making use of any known gear train diagram of the devices for taking up the drive torque reaction (retaining devices), since the torque transmitting gears and above-mentioned devices should meet similar requirements.

The torque transmitting gear should provide the transmission of the drive torque to the trunnion ring allowing for certain inconsistency in the position of the trunnion ring and gear hub of the low-speed reducer.

The torque transmitting gear, illustrated in FIG. 11, satisfies the above-specified requirements. Moreover, it ensures the damping of dynamic loads on the multimotor drive, a feature enhancing its working ability.

Thus, the problem of reducing the converter overall dimensions without an increase in the loads on the bearing units is solved in the proposed converter.

As compared with the known converter with a stationary drive, the overall dimensions of the herein-proposed converter are decreased by the size of the bearing unit and toothed clutch or spindle.

A comparison of the proposed converter with that having a multimotor drive mounted on the drive trunnion shows that the converter overall dimensions are decreased by the size of the bearing unit with the loads on the bearing unit on the side of the multimotor drive being also reduced.

In the proposed converter the maximum loads range within 0.5P–P whereas in the known converter they amount to $P+P_1$ (where $P_1$ — weight of multimotor drive set on the trunnion).

And, finally, if the thus-embodied converter is compared with that with the body secured on the output shaft of a stationary drive reducer, with the loads on reducer bearings varying inversely with the reducer overall dimensions, a more favourable design principle is obtained.

In the known converter the loads on the bearings can be decreased to 1.2P–1.3P with the converter overall dimensions increasing to that of the converter with a stationary drive in which the reducer output shaft is coupled with the ring trunnion through a toothed clutch or a spindle.

In the proposed converter the minimum overall dimensions are obtainable along with the minimum loads (0.5P–P) on the bearings of the multimotor drive low-speed reducer.

It should be pointed out that in the proposed converter the problem of reducing the converter overall dimensions without an increase in bearing loads is set without any design complications whatever. All units are simple in manufacture, erection and servicing.

What we claim is:

1. A converter comprising: a trunnion ring with trunnions; a body secured in said trunnion ring; at least one multimotor drive mounted with a gear hub of a low-speed reducer on said ring trunnion; a bush arranged at an end of said trunnion of the side of said multimotor drive; a socket disposed in said gear hub of the low-speed reducer and adapted to be joined with said bush, whose external surface is adjusted in shape and size to fit the corresponding surface of the socket, through which said ring trunnion is coupled with said gear hub of the low-speed reducer by means of a flexible joint.

2. A converter of claim 1, wherein said socket of the gear hug of the low-speed reducer is fixed axially.

3. A converter of claim 1, wherein said socket of the gear hub of the low-speed reducer is mounted movably axially.

4. A converter of claim 1, wherein in said gear hub of the low-speed reducer is mounted a bush fitted with radial barrel-shaped teeth, and said gear hub of the low-speed reducer of said multimotor drive is provided with straight teeth mating with the barrel-shaped bush teeth.

5. A converter of claim 4, wherein the barrel-shaped teeth of said bush and straight teeth of said hub are joined with the help of an annular socket.

6. A converter of claim 1, wherein said bush of said gear hub of the low-speed reducer are provided with projections with the bush and hub projections being separated by resilient elements, such as, springs.

7. A converter of claim 1, wherein said trunnion of the converter trunnion ring is furnished with a tail made integral therewith, and in said gear hub of the low-speed reducer is mounted a bush fitted with barrel-shaped teeth aligned axially with the trunnion and having a slot conjugated by means of inserts with said tail, with said bush being disposed intermediate of the straight teeth of said gear hub of the low-speed reducer.

8. A converter of claim 7, wherein on the slot side said bush is provided with a tire enhancing its strength.

9. A converter of claim 7, wherein said gear hub of the low-speed reducer is provided with ribs, preferably circular.

10. A converter of claim 1, wherein on the side of said trunnion ring said gear hub of the low-speed reducr of said multimotor drive is fitted with projections and said trunnion ring is provided with projections mating with the hub projections with the help of inserts conjugated with one of the projections, preferably, along the cylindrical surface.

11. A converter of claim 1, wherein said trunnion ring is coupled with said gear hub of the low-speed reducer of the multimotor drive through a torque transmitting gear made in the form, e.g., of at least one torsion shaft mounted rotatably in bearings on said trunnion ring with the ends of the torsion shaft carrying rigidly fixed cranks connected by means of articulated rods to projections of said gear hub of the low-speed reducer of the converter multimotor drive.

* * * * *